US007642731B2

(12) United States Patent
Park

(10) Patent No.: US 7,642,731 B2
(45) Date of Patent: Jan. 5, 2010

(54) INVERTER FOR DRIVING LAMP AND METHOD FOR DRIVING LAMP USING THE SAME

(75) Inventor: Sung Yong Park, Gumi-si (KR)

(73) Assignee: LG. Display Co., Ltd., Seoul (KR)

( * ) Notice: Subject to any disclaimer, the term of this patent is extended or adjusted under 35 U.S.C. 154(b) by 202 days.

(21) Appl. No.: 11/646,703

(22) Filed: Dec. 28, 2006

(65) Prior Publication Data

US 2008/0001943 A1 Jan. 3, 2008

(30) Foreign Application Priority Data

Jun. 30, 2006 (KR) ..... 10-2006-0061527

(51) Int. Cl.
*H05B 41/36* (2006.01)
*G09G 5/00* (2006.01)

(52) U.S. Cl. ..... 315/307; 345/214

(58) Field of Classification Search ..... 315/291, 315/307, 169.3, 209 R, 246; 345/214, 204, 345/76, 77, 78, 84

See application file for complete search history.

(56) References Cited

U.S. PATENT DOCUMENTS

| | | | | |
|---|---|---|---|---|
| 6,680,588 | B2 * | 1/2004 | Park et al. | 315/312 |
| 6,930,898 | B2 * | 8/2005 | Jeon et al. | 363/98 |
| 7,365,500 | B2 * | 4/2008 | Jang | 315/274 |
| 7,411,355 | B2 * | 8/2008 | Jang et al. | 315/209 R |
| 2003/0151601 | A1 * | 8/2003 | Chung et al. | 345/211 |
| 2004/0008176 | A1 * | 1/2004 | Nuimura | 345/102 |
| 2006/0001915 | A1 * | 1/2006 | Chang | 358/443 |

* cited by examiner

*Primary Examiner*—Douglas W Owens
*Assistant Examiner*—Minh D A
(74) *Attorney, Agent, or Firm*—Brinks Hofer Gilson & Lione

(57) ABSTRACT

A lamp driving method and an inverter for driving the lamp are disclosed which can stably maintain a desired duty ratio of a pulse width modulation (PWM) signal for controlling driving of a lamp. The method for driving lamp, comprising: generating an inner pulse width modulation (PWM) signal;

outputting a DC level in response to a duty ratio of an external PWM signal; selectively outputting the external PWM signal or the inner PWM signal in accordance with the DC level; and generating an AC drive signal Acs in response to the external PWM signal or the inner PWM signal, and supplying the AC drive signal to the lamp.

6 Claims, 5 Drawing Sheets

INVERTER FOR DRIVING LAMP AND METHOD FOR DRIVING LAMP USING THE SAME

This application claims the benefit of the Korean Patent Application No. 10-2006-61527, filed on Jun. 30, 2006, which is hereby incorporated by reference as if fully set forth herein.

BACKGROUND OF THE INVENTION

1. Field of the Invention

The present invention relates to a lamp driving method and an inverter which can stably maintain a desired duty ratio of a pulse width modulation (PWM) signal for controlling driving of a lamp.

2. Discussion of the Related Art

Typically, liquid crystal display (LCD) devices display an image by controlling the light transmittance of liquid crystals. For this function, such an LCD device includes a liquid crystal panel having pixel regions arranged in the form of a matrix, and a driving circuit for driving the liquid crystal panel.

A plurality of gate lines and a plurality of data lines are arranged on the liquid crystal panel such that they intersect each other. The pixel regions are arranged in regions defined by intersections of the gate lines and data lines, respectively. In each pixel region, pixel electrodes and a common electrode are formed, to apply an electric field. Each pixel electrode is connected with a switching device, namely, a thin film transistor (TFT). The TFT is turned on by a scan pulse supplied from the associated gate line, to charge a data signal on the associated data line in the pixel electrode.

The driving circuit includes a gate driver for driving the gate lines, a data driver for driving the data lines, and a timing controller for supplying control signals respectively adapted to control the gate driver and data driver. The driving circuit also includes a backlight unit for irradiating light to the liquid crystal panel, and an inverter for driving the backlight unit.

The backlight unit includes a lamp functioning as a light source for emitting light. The lamp emits light as it is driven by an AC drive signal from the inverter.

The inverter supplies the AC drive signal, which is adapted to drive the lamp, to the backlight unit. Since the lamp is driven in a continuous mode, it consumes a large amount of current. As such, the inverter operates in a burst mode, to periodically turn on/off the lamp, and thus, to reduce the current consumption of the lamp. In this case, the inverter supplies or cuts off the AC drive signal for driving of the lamp, in response to an externally-supplied PWM signal.

However, when the duty ratio of the externally-supplied PWM signal is unstable, the lamp may malfunction. For example, when the duty ratio of the externally-supplied PWM signal is less than 20%, a flicker phenomenon may occur because the drive power for the lamp is weakened. Due to such a weak drive power, a protection circuit may also operate to cause the inverter to be shut down. In this case, a problem arises in that the operation of the lamp is stopped.

SUMMARY

A method is disclosed for driving a lamp. The method comprises generating an inner pulse width modulation (PWM) signal and outputting a DC level in response to a duty ratio of an external pulse width modulation (PWM) signal. The external PWM signal or the inner PWM signal is selectively output in accordance with the DC level. An AC drive signal Acs is generated in response to the external PWM signal or the inner PWM signal. The AC drive signal is supplied to the lamp.

In another aspect of the present invention, an inverter for driving a lamp, comprises an inner pulse width modulation (PWM) generator that generates an inner pulse width modulation (PWM) signal and a monitoring unit that monitors a duty ratio of an external pulse width modulation (PWM) signal, to selectively output the external PWM signal or the inner PWM signal in accordance with the monitored duty ratio. An AC drive signal generator generates an AC drive signal Acs in response to the external PWM signal or the inner PWM signal and supplying the AC drive signal to the lamp.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
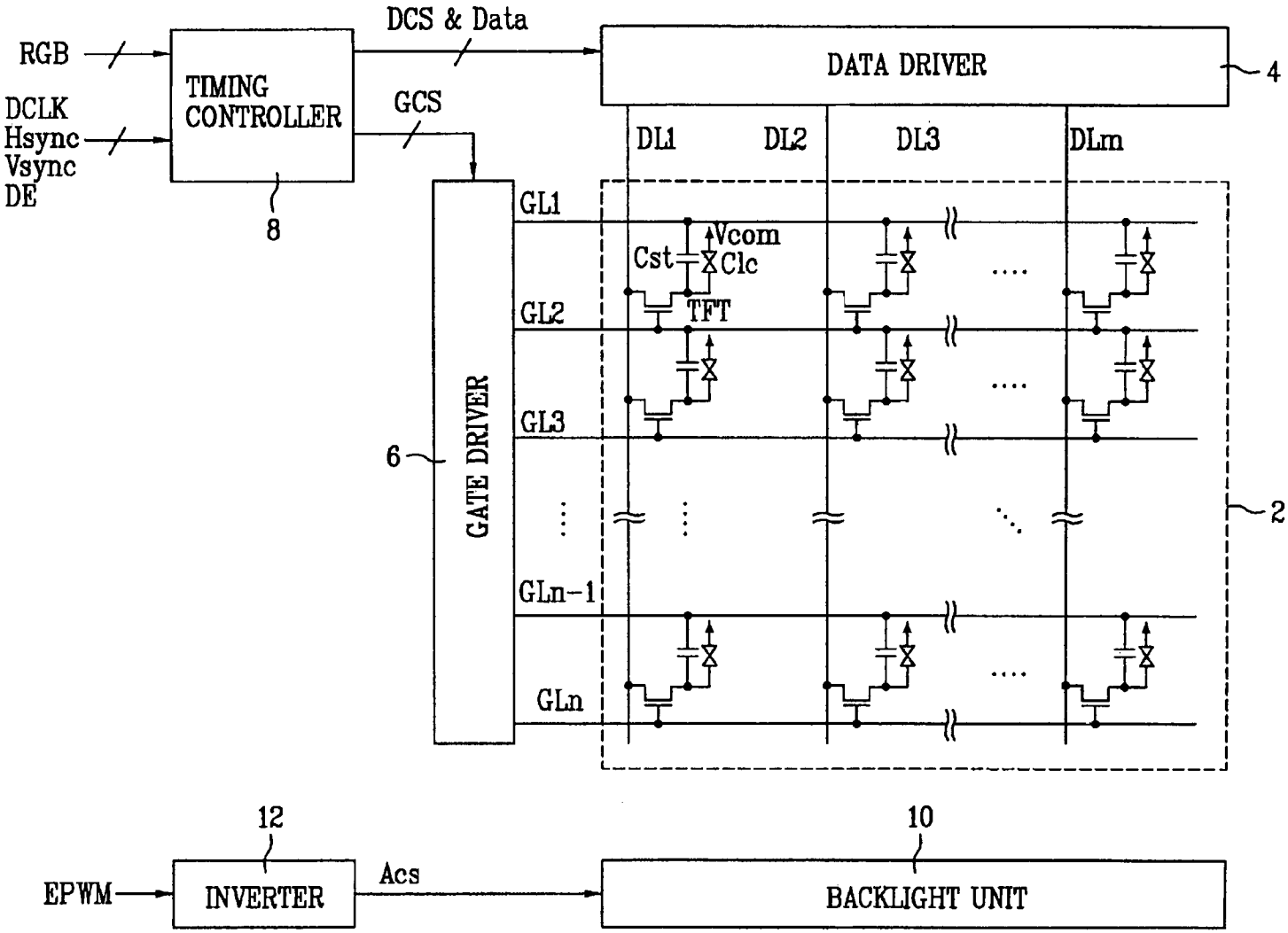
FIG. 1 is a circuit diagram illustrating a liquid crystal display (LCD) device according to an exemplary embodiment of the present invention.

FIG. 1 is a circuit diagram illustrating a liquid crystal display (LCD) device according to an exemplary embodiment of the present invention.

As shown in FIG. 1, the LCD device includes a liquid crystal panel 2 provided with pixel regions, a data driver 4 for driving a plurality of data lines DL1 to DLm, and a gate driver 6 for driving a plurality of gate lines GL1 to GLn. The LCD device also includes a timing controller 8 for controlling the data driver 4 and gate driver 6, a backlight unit 10 for irradiating light to the liquid crystal panel 2, and an inverter 12 for driving the backlight unit 10.

The liquid crystal panel 2 includes thin film transistors (TFTs) respectively formed in pixel regions defined by the gate lines GL1 to GLn and data lines DL1 to DLm, and liquid crystal capacitors Clc connected to respective TFTs. Each liquid crystal capacitor Clc includes a pixel electrode connected to the associated TFT, and a common electrode arranged to face the pixel electrode via a liquid crystal layer interposed between the pixel electrode and the common electrode. Each TFT supplies a data signal from an associated one of the data lines DL1 to DLm to the associated pixel electrode in response to a scan pulse from an associated one of the gate lines GL1 to GLn. Each liquid crystal capacitor Clc is charged with a differential voltage between the data signal supplied to the associated pixel electrode and a common voltage supplied to the associated common electrode. In accordance with the differential voltage of the liquid crystal capacitor Clc, the orientation of liquid crystal molecules of the liquid crystal layer in the associated pixel region is varied, thereby causing the transmittance of light through the liquid crystal layer to be adjusted. Thus, gray-scale display is achieved. A storage capacitor Cst is connected to each liquid crystal capacitor Clc in parallel, in order to sustain the voltage charged in the liquid crystal capacitor Clc until a next data signal is supplied. The storage capacitor Cst is formed in accordance with overlap of the associated pixel electrode with a gate line, which is arranged upstream from the gate line associated with the pixel electrode, via an insulating film. Alternatively, the storage capacitor Cst may be formed in accordance with overlap of the pixel electrode with a storage line via an insulating film.

The data driver 4 converts digital image data Data into analog image data in accordance with a data control signal DCS from the timing controller 8. Analog image data associated with one horizontal line is supplied from the data driver 4 to the data lines DL1 to DLm for every horizontal period in which a scan pulse is sequentially supplied to the gate lines GL1 to GLn. That is, the data driver 4 selects a gamma voltage having a certain level determined in accordance with a gray-scale value of the analog image data, and supplies the selected gamma voltage to the data lines DL1 to DLm.

The gate driver 6 includes a shift register for sequentially generating a scan pulse, namely, a gate high pulse, in response to a gate control signal GCS from the timing controller 8.

The timing controller 8 modulates image data RGB externally supplied thereto such that the image data RGB drives the liquid crystal panel 2, and then supplies the modulated image data to the data driver 4. The timing controller 8 generates the gate control signal GCS and data control signal DCS, based on externally-supplied synchronizing signals DCLK, DE, Hsync, and Vsync, to control the data driver 4 and gate driver 6, respectively.

The backlight unit 10 includes a light source for emitting light, and an optical unit for diffusing and condensing the light from the light source, namely, incident light, to achieve an enhancement in light efficiency. Typically, a cylinder type lamp such as a cold cathode fluorescent lamp (CCFL) or an external electrode fluorescent lamp (EEFL) is used. The lamp is driven by an AC drive signal Acs from the inverter 12.

The inverter 12 generates and supplies the AC drive signal Acs, for driving of the lamp. In this case, the inverter 12 operates in a burst mode, namely, periodically supplies and cuts off the AC drive signal Acs in response to an external pulse width modulation (EPWM) signal externally input to the inverter 12, to periodically turn on/off the lamp. The inverter 12 also monitors the EPWM signal, in order to drive the lamp using an inner pulse width modulation (IPWM) signal generated in an IPWM generator when the EPWM signal is unstable.

Figure 2:
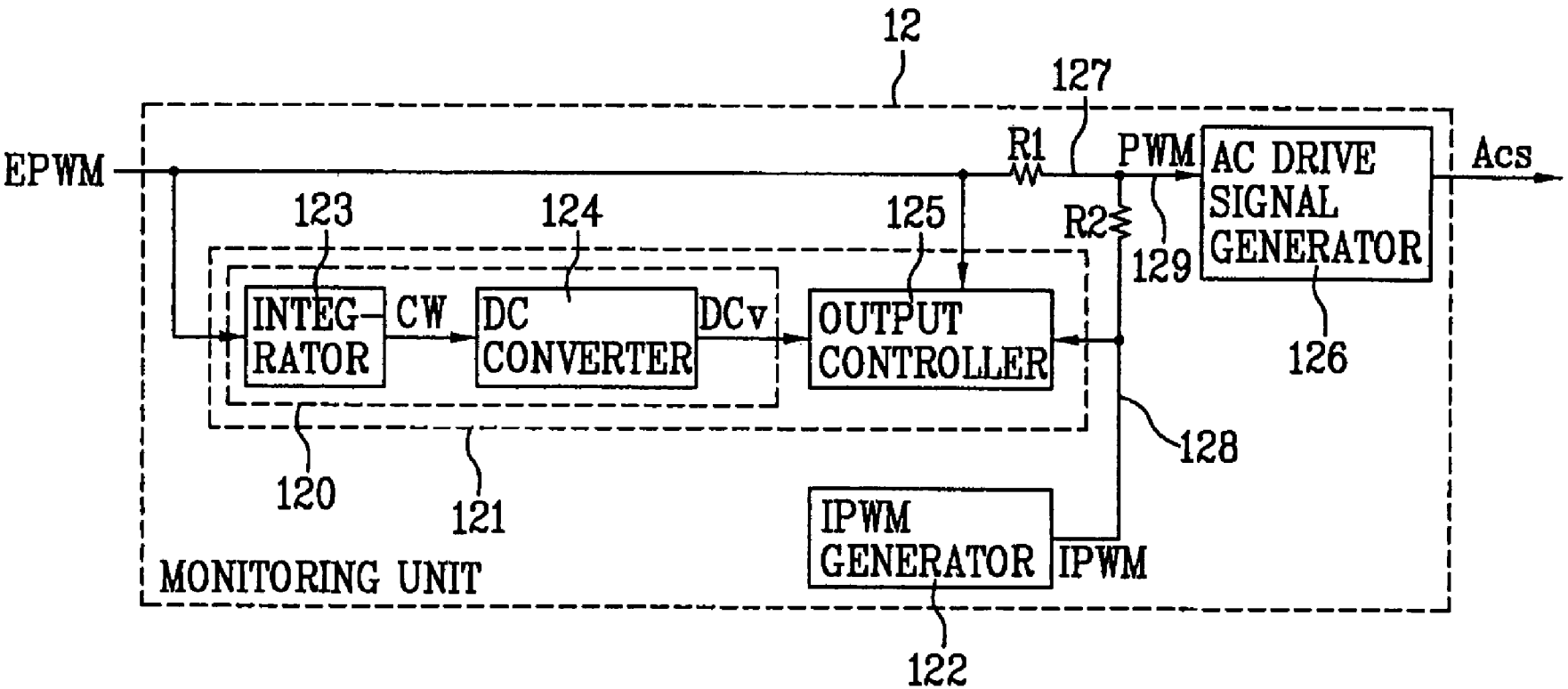
FIG. 2 is a circuit diagram illustrating the inverter shown in FIG. 1.

FIG. 2 is a circuit diagram illustrating the inverter shown in FIG. 1.

As shown in FIG. 2, the inverter 12 includes an inner PWM (IPWM) generator 122, a monitoring unit 121 and an AC drive signal generator 126. The IPWM generator 122 generates the IPWM signal which has a fixed duty ratio. The monitoring unit 121 monitors the duty ratio of the EPWM signal, cuts off the EPWM signal when the duty ratio of the monitored EPWM signal is unstable, and supplies the IPWM signal to a PWM input line 129, in place of the cut-off EPWM signal. The AC drive signal generator 126 generates an AC drive signal Acs in response to the EPWM signal or IPWM signal and supplies the AC drive signal to the lamp. The inverter 12 also includes a first resistor R1 arranged on an EPWM signal supply line 127 such that it has an arrangement parallel with an IPWM signal supply line 128, a second resistor R2 arranged on the IPWM signal supply line 128 such that it has an arrangement parallel with the EPWM signal supply line 127.

The monitoring unit 121 simultaneously receives the EPWM signal and the IPWM signal from the IPWM generator 122. The monitoring unit 121 detects the duty ratio of the EPWM signal, and bypasses the EPWM signal or IPWM signal to the ground in accordance with the detected duty ratio.

If a PWM signal having a duty ratio of less than 20% is supplied to the AC drive signal generator 126, the lamp included in the backlight unit 10 is unstably driven. Accordingly, the duty ratio of the PWM signal should be maintained at a value of 20% or more.

The monitoring unit 121 maintains the duty ratio of the EPWM signal supplied to the AC drive signal generator 126 at a value of 20% or more. To this end, when the EPWM signal has a duty ratio of less than 20%, it is bypassed to ground. In this case, the IPWM signal, which has a fixed duty ratio of 20% or more, is supplied to the AC drive signal generator 126. On the other hand, when the EPWM signal has a duty ratio of 20% or more, the IPWM signal is bypassed to ground. In this case, the EPWM signal is supplied to the AC drive signal generator 126.

The IPWM generator 122 generates the IPWM signal, which has a fixed duty ratio of 20% or more, and supplies the generated IPWM signal to both the monitoring unit 121 and the PWM signal supply line 129 via the IPWM signal supply line 128.

When the monitoring unit 121 bypasses the EPWM signal to ground, the first resistor R1 causes the IPWM signal to be supplied to the AC drive signal generator 126 via the PWM signal supply line 129 without being bypassed to ground along with the EPWM signal.

When the monitoring unit 121 bypasses the IPWM signal to ground, the second resistor R2 causes the EPWM signal to be supplied to the AC drive signal generator 126 via the PWM signal supply line 129 without being bypassed to ground along with the IPWM signal.

The monitoring unit 121 includes a duty ratio detector 120 for converting the EPWM signal into a DC level DCv, and an output controller 125 for selectively supplying the EPWM signal or IPWM signal in accordance with the DC level DCv output from the duty ratio detector 120.

The duty ratio detector 120 includes an integrator 123 for integrating the EPWM signal, to convert the EPWM signal into a triangle wave CW, and a DC converter 124 for converting the triangle wave CW from the integrator 123 into a DC level DCv and outputting the DC level DCv.

The integrator 123 integrates the EPWM signal, to convert the EPWM signal into a triangle wave CW, and supplies the triangle wave CW to the DC converter 124.

The DC converter 124 modulates the pulse width of the triangle wave CW from the integrator 123 into a DC level DCv, and supplies the DC level DCv to the output controller 125. Here, the DC level DCv is proportional to the duty ratio of the EPWM signal.

The output controller 125 bypasses the EPWM signal or IPWM signal in accordance with the DC level DCv from the duty ratio detector 120, that is, the duty ratio of the EPWM signal, thereby causing the EPWM signal or IPWM signal not bypassed to ground to be supplied to the AC drive signal generator 126 via the PWM supply line 129.

For example, when the input EPWM signal has a duty ratio of less than 20%, it is bypassed. In this case, the IPWM signal is supplied to the AC drive signal generator 126 via the PWM supply line 129. On the other hand, when the input EPWM signal has a duty ratio of 20% or more, the IPWM signal is bypassed to the ground. In this case, the EPWM signal is supplied to the AC drive signal generator 126 via the PWM supply line 129.

The AC drive signal generator 126 generates the AC drive signal Acs, using a voltage signal switched in response to the PWM signal supplied from the PWM supply line 129, and outputs the AC drive signal Acs to the backlight unit 10.

Figure 3:
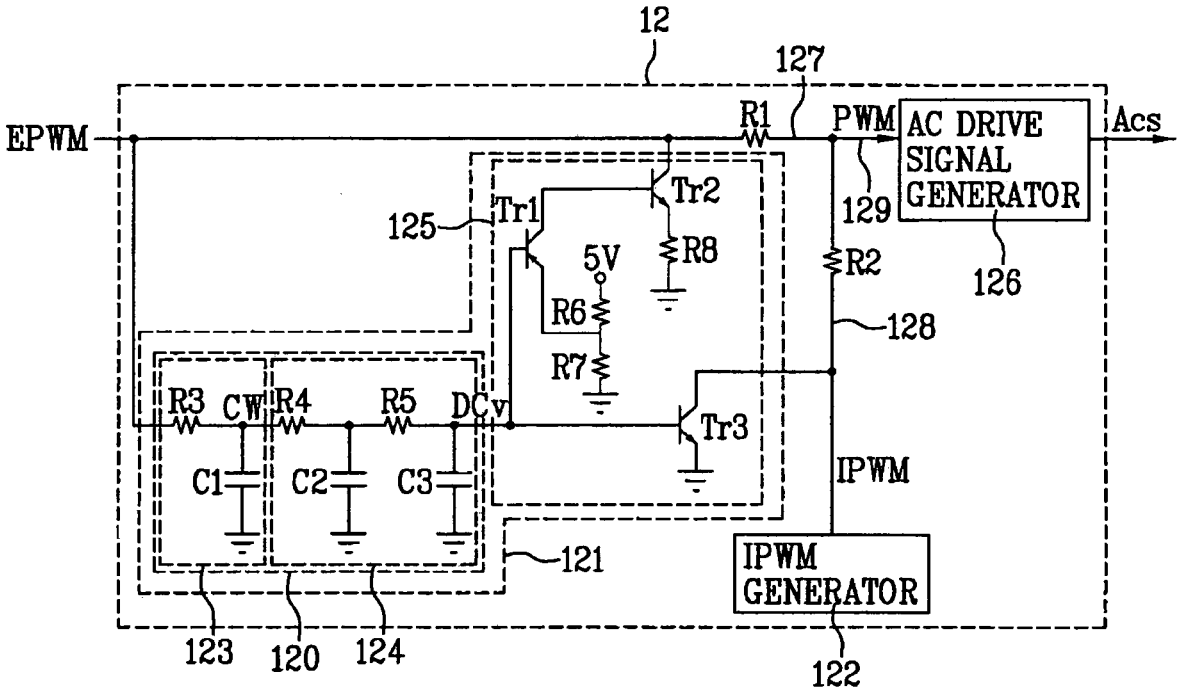
FIG. 3 is an equivalent circuit diagram illustrating the inverter shown in FIG. 2.
Figure 4:
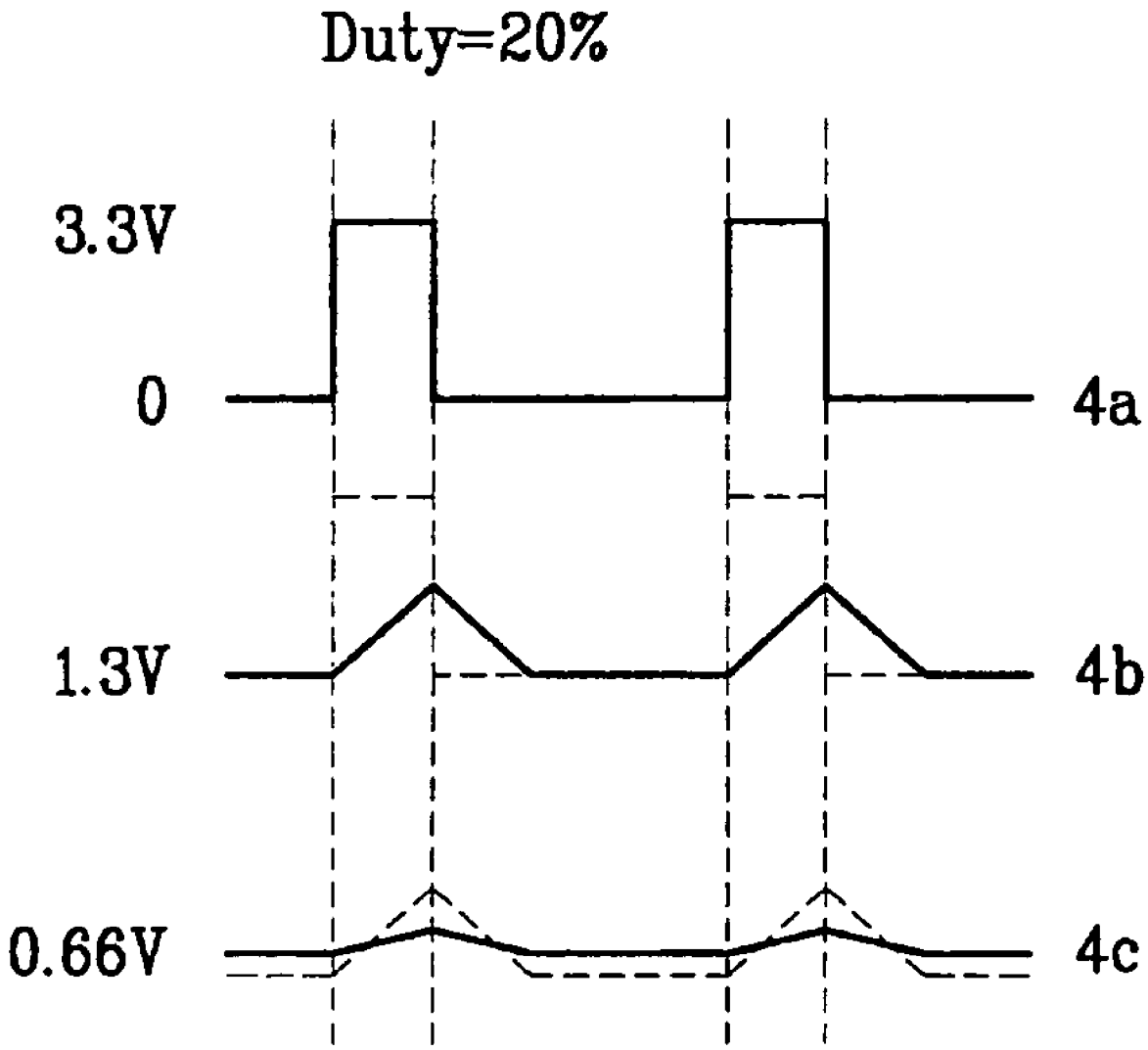
FIG. 4 is a waveform diagram depicting a conversion of the waveform of an external pulse width modulation (EPWM) signal input to the monitoring unit where the duty ratio of a PWM signal is set to 20%.
Figure 5:
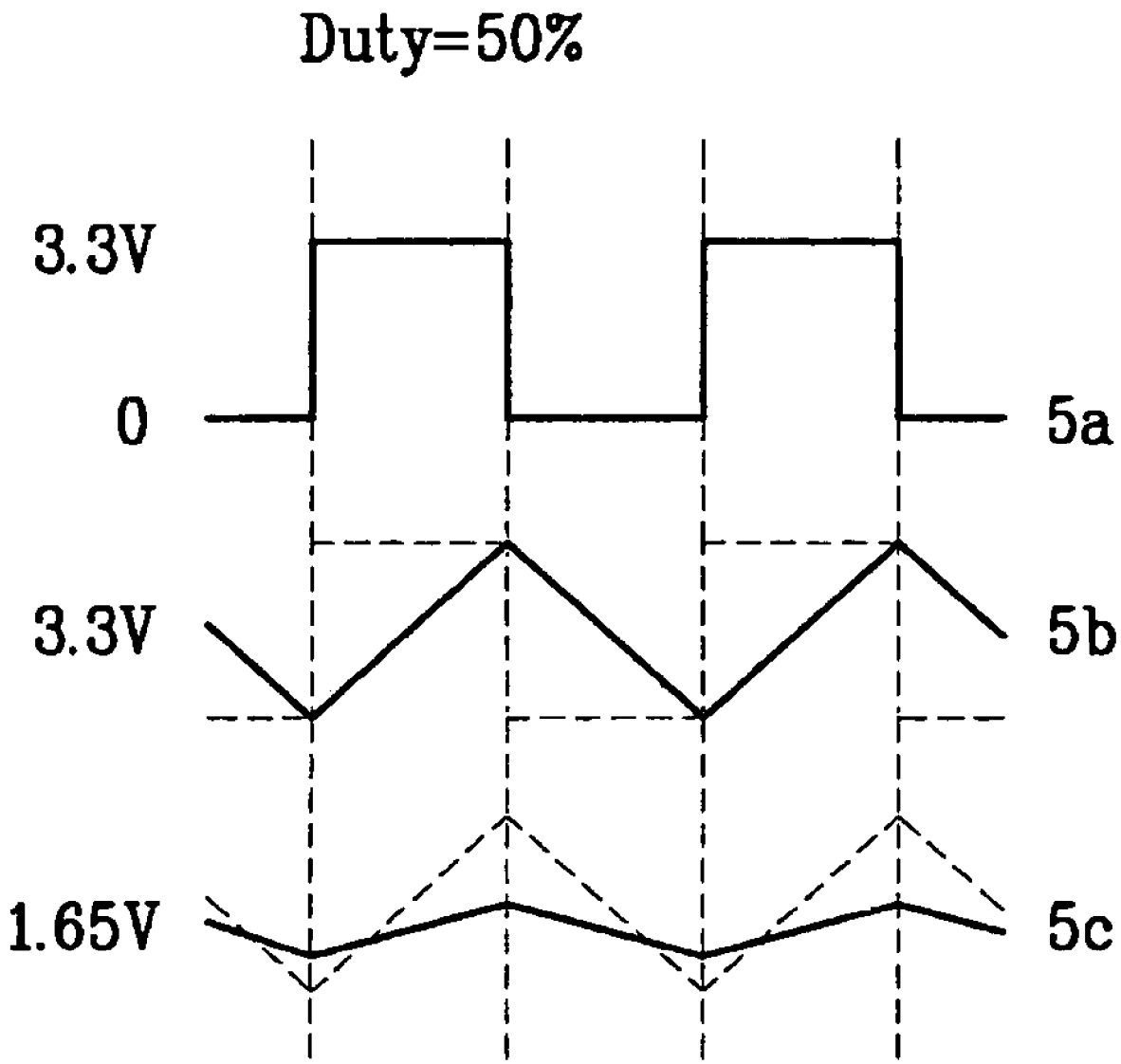
FIG. 5 is a waveform diagram depicting a conversion of the waveform of the EPWM signal input to the monitoring unit where the duty ratio of the PWM signal is set to 50%.

FIG. 3 is an equivalent circuit diagram illustrating the inverter shown in FIG. 2. FIG. 4 is a waveform diagram depicting a conversion of the waveform of the EPWM signal input to the monitoring unit where the duty ratio of the PWM signal is set to 20%. FIG. 5 is a waveform diagram depicting a conversion of the waveform of the EPWM signal input to the monitoring unit where the duty ratio of the PWM signal is set to 50%. The configuration and operation of the monitoring unit 121 will be described in more detail with reference to FIGS. 3 to 5.

As shown in FIG. 3, the integrator 123 includes a third resistor R3 connected to an EPWM signal input line in series, and a first capacitor C1 connected between an output terminal of the third resistor R3 and ground. In the integrator 123, the first capacitor C1 charges/discharges the EPWM signal in accordance with a time constant determined by the third resistor R3 and first capacitor C1. Accordingly, where the duty ratio of the PWM signal is set to 20%, as shown in FIG. 4, the integrator 123 converts an EPWM signal 4*a* having an amplitude of 3.3 V, which is sequentially input to the integrator 123, into a triangle wave (CW) 4*b* having an amplitude of 1.3 V, and outputs the triangle wave 4*b*.

On the other hand, where the duty ratio of the PWM signal is set to 50%, as shown in FIG. 5, the integrator 123 converts an EPWM signal 5*a*, which is sequentially input to the integrator 123, into a triangle wave (CW) 5*b* having an amplitude of 3.3 V, in accordance with the time constant determined by the third resistor R3 and first capacitor C1, and outputs the triangle wave 5*b*.

The DC converter 124, which is a smoothing circuit, includes a fourth resistor R4 and a fifth resistor R5 connected to an output terminal of the integrator 123 in series, a second capacitor C2 connected to an output terminal of the fourth resistor R4 and ground, and a third capacitor C3 connected between an output terminal of the fifth resistor R5 and ground. The DC converter 124 smoothes the triangle wave CW into a DC level DCv in accordance with charging/discharging operations based on a time constant determined by the fourth resistor R4 and second capacitor C2 and a time constant determined by the fifth resistor R5 and third capacitor C3, and then outputs the DC level DCv. Accordingly, where the duty ratio of the PWM signal is set to 20%, as shown in FIG. 4, the triangle wave (CW) 4*b*, which has an amplitude of 1.3 V, is converted into a DC level DCv having an amplitude of 0.66 V by the DC converter 124 which, in turn, outputs the DC level DCv.

On the other hand, where the duty ratio of the PWM signal is set to 50%, as shown in FIG. 5, the triangle wave (CW) 5*b*, which has an amplitude of 3.3 V, is converted into a DC level DCv having an amplitude of 1.65 V by the DC converter 124 in accordance with the time constant determined by the fourth resistor R4 and second capacitor C2 and the time constant determined by the fifth resistor R5 and third capacitor C3. The DC level DCv is then output from the DC converter 124.

The output controller 125 includes a first switching device Tr1 and a second switching device Tr2. The first switching device Tr1 for turning on the second switching device Tr2 in accordance with the DC level DCv output from the DC converter 124. When the second switching device Tr2 is turned on, it bypasses the EPWM signal to the ground. The output controller 125 also includes a sixth resistor R6 and a seventh resistor R7 for dividing an input voltage of, for example, 5 V, to supply the resulting voltage as a reference voltage, and an eighth resistor R8 connected between the second switching device Tr2 and ground in series. The output controller 125 further includes a third switching device Tr3 which is turned on in accordance with the DC level DCv, to bypass the IPWM signal to ground.

The first switching device Tr1 is constituted by a PMOS transistor. Accordingly, when the DC level DCv received from the DC converter 124 is lower than the reference voltage by a threshold voltage, the first switching device Tr1 is turned on, thereby turning on the second switching device Tr2. For example, when the input EPWM signal has a duty ratio of less than 20%, namely, when the input DC level DCv is lower than 0.66 V, the first switching device Tr1 is turned on, thereby turning on the second switching device Tr2. In this case, accordingly, the EPWM signal is bypassed to the ground via the second switching device Tr2. Thus, the IPWM signal, which has a stable duty ratio of 20% or more, is supplied from the IPWM generator 122 to the AC drive signal generator 126 via the PWM supply line 129.

On the other hand, when the input DC level DCv is not lower than the reference voltage by the threshold voltage, namely, when the input DC level DCv is not lower than 0.66 V, the first and second switching devices Tr1 and Tr2 are in an OFF state, whereas the third switching device Tr3 is turned on. In this case, accordingly, the IPWM signal is bypassed to ground via the third switching device Tr3. Thus, the EPWM signal, which has a stable duty ratio of 20% or more, is supplied to the AC drive signal generator 126 via the PWM supply line 129.

Meanwhile, where the duty ratio of the PWM signal is set to 50%, the first switching device Tr1 is maintained in an OFF state unless the input DC level DCv is lower than 0.66 V, even when the DC level DCv is lower than 1.65 V. This is because the voltage applied to the first switching device Tr1 is not lower than the reference voltage by the threshold voltage. In this case, accordingly, the IPWM signal is bypassed to the ground via the third switching device Tr3. Thus, only the EPWM signal, which has a duty ratio of 20% or more, is supplied to the AC drive signal generator 126 via the PWM supply line 129.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

As apparent from the above description, the above-described lamp driving method and apparatus according to the present invention provide the following effect.

That is, in accordance with the present invention, an externally-input EPWM signal or an IPWM signal generated from the IPWM generator is selectively supplied in accordance with the duty ratio of the externally-input EPWM signal. Accordingly, it is possible to generate a stable AC drive signal, using the EPWM signal or IPWM signal, which has a stable duty ratio, and thus, to stably drive a backlight.

What is claimed is:

1. An inverter for driving a lamp, comprising:

an inner pulse width modulation (PWM) generator that generates an inner pulse width modulation (PWM) signal;

a monitoring unit that monitors a duty ratio of an external pulse width modulation (PWM) signal, to selectively output the external PWM signal or the inner PWM signal in accordance with the monitored duty ratio; and an AC drive signal generator that generates an AC drive signal in response to the external PWM signal or the inner PWM signal and supplies the AC drive signal to the lamp, wherein the monitoring unit comprises:

a duty ratio detector that detects the duty ratio of the external PWM signal in the form of a DC voltage; and an output controller that bypasses the external PWM signal or the inner PWM signal in accordance with the detected duty ratio, wherein the duty ratio detector comprises:

an integrator that integrates the external PWM signal; and a DC converter that converts the integrated signal from the integrator into a DC voltage, and wherein the output controller comprises:

a first switching device that supplies a control signal in response to the DC voltage from the duty ratio detector;

a second switching device that bypasses the external PWM signal to ground in response to the control signal; and a third switching device that bypasses the inner PWM signal to around in response to the DC voltage from the duty ratio detector.

2. The inverter according to claim 1, wherein the integrator converts the external PWM signal into a triangle wave CW, and the DC converter modulates a pulse width of the triangle wave CW into the DC level DCv.

3. The inverter according to claim 1, wherein the inner PWM signal has a fixed duty ratio.

4. The inverter according to claim 1, wherein the first switching device compares the DC voltage with a reference voltage, and selectively supplies the control signal in accordance with a result of the comparison.

5. The inverter according to claim 4, wherein the output controller comprises a first voltage-dividing resistor and a second voltage-dividing resistor that divide an input voltage, to generate the reference voltage.

6. The inverter according to claim 1, further comprising:

a first resistor to prevent the inner PWM signal from being bypassed along with the external PWM signal; and a second resistor to prevent the external PWM signal from being bypassed along with the inner PWM signal.

* * * * *

UNITED STATES PATENT AND TRADEMARK OFFICE

CERTIFICATE OF CORRECTION

PATENT NO. : 7,642,731 B2
APPLICATION NO. : 11/646703
DATED : January 5, 2010
INVENTOR(S) : Sung Yong Park It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 210 days.

Signed and Sealed this

Sixteenth Day of November, 2010

David J. Kappos

David J. Kappos
*Director of the United States Patent and Trademark Office*